US005090463A

United States Patent [19]

Jeantelot

[11] Patent Number: 5,090,463

[45] Date of Patent: Feb. 25, 1992

[54] PROCESS FOR SPLITTING TIMBER QUARTERS TO OBTAIN THIN CUTS AND MACHINE ITS IMPLEMENTATION

[76] Inventor: Maurice Jeantelot, 5, Grande Rue, F-10110 Landreville, France

[21] Appl. No.: 699,759

[22] Filed: May 14, 1991

[30] Foreign Application Priority Data

May 16, 1990 [FR] France ..... 90 06101

[51] Int. Cl.[5] ..... B27C 1/00; B27L 7/00

[52] U.S. Cl. ..... 144/363; 144/162 A; 144/164; 144/193 R; 144/193 A; 144/366

[58] Field of Search ..... 144/162 R, 162 A, 164, 144/193 R, 193 A, 363, 366, 367

[56] References Cited

U.S. PATENT DOCUMENTS 1,663,905 3/1928 Dietz ..... 144/366

2,760,533 8/1956 Bass ..... 144/185

4,799,519 1/1989 Forbes et al. ..... 144/366

*Primary Examiner*—W. Donald Bray

*Attorney, Agent, or Firm*—Rodgers & Rodgers

[57] ABSTRACT

According to this invention, this splitting process to obtain thin cuts of a determined thickness consists in simultaneously attacking the two ends of a timber quarter laying horizontally and secured at its two ends between two gripping devices (3) which may oscillate transversely, by means of two splitting tools (7), each also able to oscillate transversely in order to follow the grain of the wood, at the free end of a shaft (8A) of a control cylinder (8), shaft on which each corresponding gripping devices (3) is supported and slides, and the support (4) of this jaw which is actuated and moved by a cylinder (5), and which actuates, as a result, the positioning for tightening or release of this machine.

12 Claims, 4 Drawing Sheets

PROCESS FOR SPLITTING TIMBER QUARTERS TO OBTAIN THIN CUTS AND MACHINE ITS IMPLEMENTATION

This invention consists of a process for splitting quarter timbers to obtain thin cuts and planks split along the medullar rays of these quarters and used in the manufacture of bottom boards for casks and barrels. More especially, it consists of a splitting process which enables, in a single pass of the splitting and opening tool, subjected to a continuous pressure without impact or percussion, the obtaining of thin cuts of the same determined or selected thickness along the grain of the timber used, that is to say, in the direction of its fibres.

In addition, this invention relates to a timber quarter splitting machine which implements this process, and is designed to carry out the operation to split to the thin cut thickness required whereas each quarter timber produced is supported and secured with its longitudinal upper surface in the horizontal position.

In the technique currently used to obtain thin cuts used for the manufacture of bottom boards, each timber is first of all split into four or six quarters, using a splitting tool functioning in the same way as an axe, whereas it is held in the vertical position. Each quarter obtained is then taken to be split by one of its ends, using a wedge-shaped splitter subjected to the sudden pressure of a ram developing a compression force of twelve to fifteen tons, in order to produce planks split to a thickness slightly greater than the double of that chosen for each thin cut. It should be noted that in most cases, the wedge does not act as a splitter between the layers of timber fibres but its effect produces rather a splintering of the timber without regard for its grain. Consequently, the planks obtained in an irregular double thickness must be planed in order to even out the thickness and then, cutting into two is with a band saw, in such as way that there is a risk that the timber grain is cut in places.

Consequently the timber quarter splitting process under this invention is designed to eliminate the greater part of the disadvantages of the currently known technique and, in particular, enable thin cuts to be obtained in a single pass of the splitter, these thin cuts being produced from a timber quarter according to the thickness chosen and retaining the integrity of the grain and requiring no planing off of the overthickness nor cutting into two with a band saw so that all the thin cuts obtained are usable with no loss of timber (off-cuts) and with a higher quality as required for the manufacture of bottom boards.

According to this invention, the timber quarter splitting process designed to obtain thin cuts of equal, chosen and even thicknesses, and according to which each thin cut is produced, using only one pass of the splitting tool, in the direction of the medullar rays of a timber quarter and respecting the integrity of the fibres of this timber, the special feature of which is in that it consists firstly in immobilising a timber quarter horizontally between two jaws which act on the longitudinal ends of the timber quarter and are mounted so as to oscillate transversely in relation to their translation axis, the timber quarter having its upper surface brought to the same plane as that of the top of the jaws before their tightening and then, to start the splitting operation by attacking the two ends of each timber quarter simultaneously, each by means of a splitting tool mounted in order to oscillate freely and transversely in relation to its movement axis, each splitting tool being subjected to the pressure of a ram, actuated continuously and without impact, and oriented initially before the start of splitting in a plane parallel to that of the upper longitudinal surface of the quarter and so that its front edge is at a level below that of this upper longitudinal surface, so that the difference between these levels is equivalent to the thickness required for the thin cuts during splitting, the free and transverse oscillation of each splitting tool enabling the front edge of the split or attack of these two tools to follow the timber grain, that is to say, the same direction as its fibres, without cutting them, starting respectively from each end of the quarter towards its middle part and resulting in the gradual opening out and without splintering of the timber of the first thin cut split in relation to the remaining part of the quarter from which will be produced, along its lower longitudinal surface, a second thin cut of the same thickness after turning this remaining part bottom side up so that this bottom side becomes the top side and so on to obtain a succession of thin cuts until the timber quarter is used up.

It should be noted that, under this invention, this splitting process uses two splitting tools which move towards one another during splitting, each of these tools being constituted of a wedge shaped part whose width exceeds that of the longitudinal edge of the quarter from which each thin cut is to be produced, the wedge-shaped front part of this piece having, on each upper and lower surface, a continuous slope from the front edge to the midway point which is convex and, then, a flat and more or less horizontal rear section which constitutes the heel part of the tool whose width is smaller than the front part which acts as a splitter which penetrates the wood gradually without cutting its fibres but which spreads out the layers of fibres in the direction of the medullar rays, whereas the rear part having its top and bottom surfaces parallel maintains the gap obtained by the midway part the thickness of which is less than the double of that of the thin cut and without splintering of the thin cut wood produced from the timber quarter, then the final separation of this thin cut. It should be noted that this splitting tool is designed so that the final separation is made before the penetration edge reaches the midway part of the timber quarter.

This splitting process is implemented by means of a machine whose special feature is that it consists of: a cradle or rest for the timber quarter to be split, located in the central part of its support chassis and designed to raise the quarter and maintain it in a more or less horizontal position by centring it along the longitudinal axis of the support chassis, two moving gripping devices following this longitudinal axis, located transversely to the latter in order to secure the timber quarter by its longitudinal ends and mounted in order to be able to oscillate in a direction transverse to their translation axis in the position when securing the quarter timber by its ends; a thickness guide for each of the thin cuts to produced with an adjustable and mobile fixing system above each of the jaws and overhanging in relation to the front edge or jaws of the latter, in order to constitute a stop for the upper longitudinal surface of the timber quarter and to set the thickness chosen for the thin cut to be produced whilst forcing the jaw carrying this stop to position itself by transverse oscillation on a plane parallel to that of the upper longitudinal surface of the timber quarter, before actuating the gripping device gripping movement; a splitting tool mounted on the shaft of a ram to oscillate transversely above each of the gripping device, guided flat on the top of the latter for positioning for splitting and during release as the corresponding thickness guide retracts, then left free to oscillate transversely when its mid section has gone past the front edge of the gripping device. Each splitting tool is also designed to act as a guide cam at one of the ends of each of two lateral levers which are connected, by the other end, to the corresponding thickness guide and in order to actuate retraction of the latter when the tool is forward to start the splitting operation and thus release the stop from its contact with the longitudinal face of the timber quarter short of its corresponding end, the device being such that when the splitting tool retracts after producing a thin cut, the stop is returned to its initial position to act as a support for the new surface of the remaining part of the timber quarter to be cut.

It is understood that, according to the invention, each thickness guide, and in particularly its stop transverse to the gripping device movement axis, is designed for height adjustment in relation to the front edge of the splitting tool in its initial position, located in a parallel plane above the corresponding gripping devices, in order to define the thickness of the thin cut to be obtained.

More specifically, the timber rest and raising of the timber quarter to be converted into thin cuts has two transverse struts systems perpendicular to the longitudinal axis of the machine chassis and held apart from one another with an adjustable system to support, by its ends, a timber quarter, each strut consisting of two pieces in the form of "V" cradles which are actuated to move in opposite directions to one another respectively in order to constitute a "W" shape, the middle branches of which due to their crossover position, form an "X" in which the crossover point may vary as required in height and vertically in relation to the central longitudinal axis of the chassis in order to set to the required splitting position, the timber quarter lying in the upper "V" of each strut system. It should be noted that the movements in opposite directions of one or other of the two cradles of each of the strut systems are actuated by rotation, in one direction or the other, by a gearwheel meshed into two opposing rack gears fitted round it, each of them being fixed to the respective base of each of the cradles.

Furthermore, these two "V"-shaped pieces each constituting each transverse strut system of the rest have their arms designed to pivot in order to be able to vary their opening angle as required on the basis of the angular value of the timber quarter to be converted into thin cuts, that is, 90° for a quarter of one eight, or 120° for a quarter of one twelfth.

Other characteristics of this invention will appear from the following description of the way of setting up a machine to implement the process for splitting timber quarters into thin cuts, this setting up being shown diagrammatically in the appended drawings in which.

Figure 1:
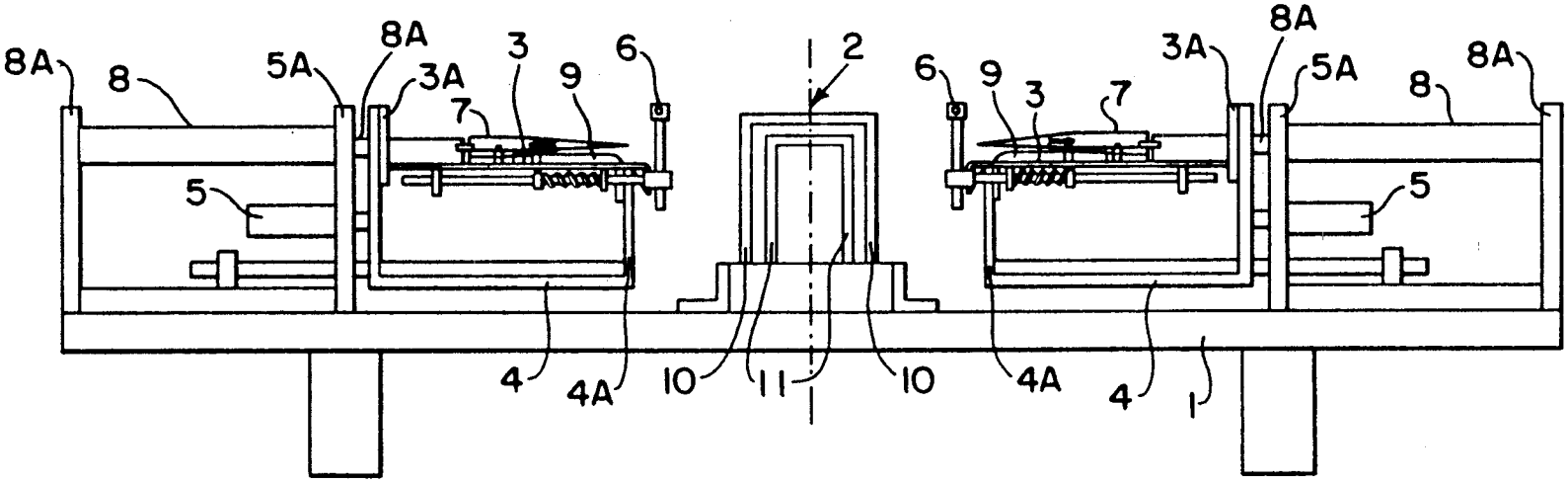
FIG. 1 is an overall diagrammatical top view of the machine.

As shown diagrammatically in FIG. 1, the splitting machine, according to this invention, is constituted of a chassis (1) in the central parts of which is fitted a cradle (2) to raise and support the timber quarter (not shown) in the longitudinal axis of the chassis. It should be noted that the cradle will be described later in more detail with reference to FIG. 2. Either side of this cradle (2) are fitted, symmetrically, two moving jaws (3) designed to grip by its ends a timber quarter to be converted and to oscillate transversely on themselves in the longitudinal axis of the chassis. To do so, each gripping device (3) is mounted to oscillate on a support (4) which moves longitudinally to the chassis (1) by means of a control cylinder (5) which is used also, as a result, to bring the corresponding jaw into the gripping or release position. Each gripping device (3) is fitted with a moving thickness guide (6) for the thin cut to be produced, this guide being described later by reference to FIGS. 3 and 4. Each jaw (3) is also fitted with a splitting tool (7), which oscillates on the end of the thickness guide (6) and guided flat, in the retraction or rest position until its starts the splitting operation, by ribs (9) protruding from the top of the gripping device (3). It should be noted that the control cylinder (5) is secured by an upright (5A) of the chassis (1) in which slides, in the top part, the shaft (8A) of the control cylinder (8), which has its rear tip supported by another upright (8A) of the chassis. Furthermore, the rear part (3A) of the gripping device (3), located to the front of its support (4) is mounted and slides on this shaft (8A) of the cylinder and its front part is supported to oscillate by means of a pivot (4b) located at the upper end of the front arm (4A) of the support (4).

Figure 2:
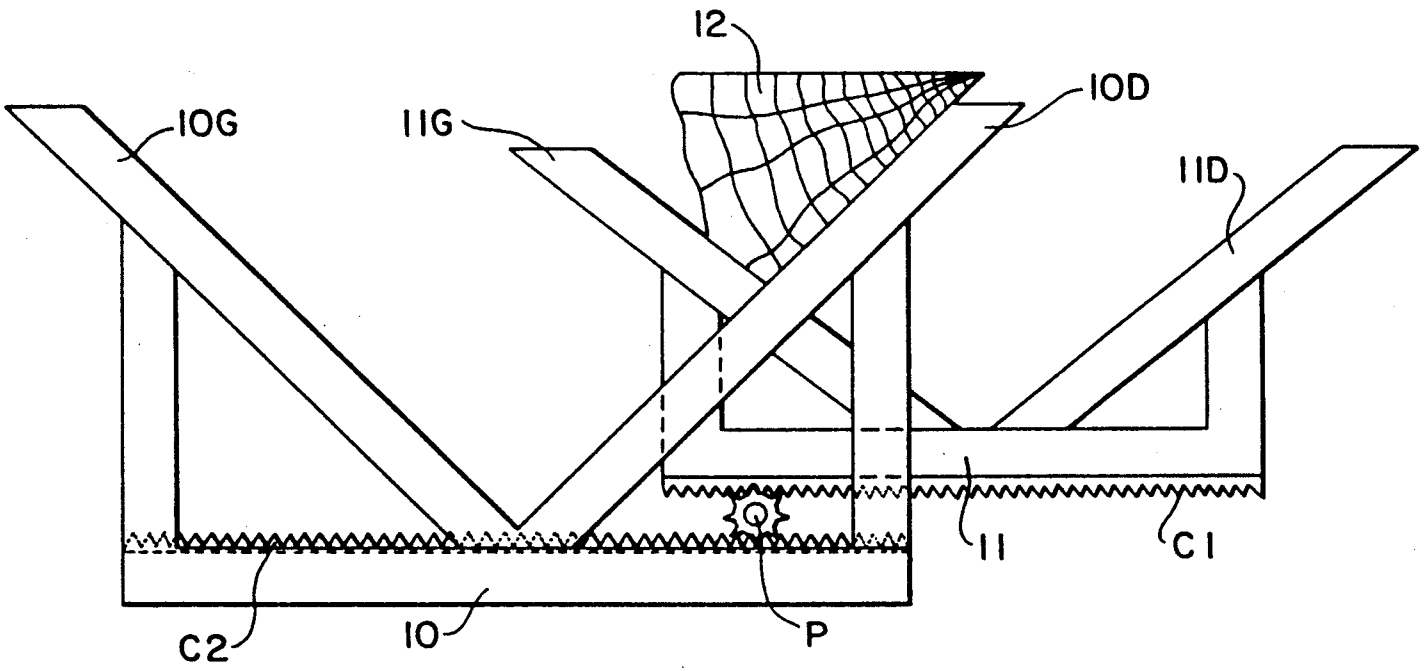
FIG. 2 is a diagrammatical side view of one of the strut assemblies of the support rest for a timber quarter to be split into thin cuts.

As can be better seen in FIG. 2, in side view, each of the two relatively movable supports 4 which are located perpendicular to the longitudinal axis of the chassis (1), is composed of two parts (10, 11), in the form of "V" cradles, which are actuated to move in opposite directions to one another in both directions, by means of a gearwheel meshed into two opposing rack gears fitted round it, each of them being fixed to the respective base of each of the cradles (10, 11). It can easily be understood, if we look at FIG. 2, that following a clockwise rotation of the gearwheel (P), the cradle (10) will be moved to the left, the cradle (11) will be moved to the right and the respective ends (10D and 11G) of their arms will support the timber quarter to set it in the splitting position with its lower surface against the end (10D) and its sapwood section against the end (11G). Inversely, if the timber quarter has to be turned over so that the surface initially underneath is to be position to face upwards under the thickness guides (6), the gearwheel (P) is rotated in an anti-clockwise direction, so that the cradle (10) is moved towards the right and the cradle (11) is moved towards the left, with the sapwood section against the end (11D) and the underside on the end (10G). It should also be noted that the cradles (10 and 11) have their arms fitted to pivot in order to be able to vary their respective opening angles in relation to the angular value of the timber quarter. In fact, as shown in FIG. 2 by way of example, the cradle (10) is open at 90° and the cradle (11) at 120°, in order to facilitate the more or less horizontal positioning of the upper surface of the timber quarter to be split into thin cuts which represents initially approximately an eighth or a twelfth of the log.

Figure 3:
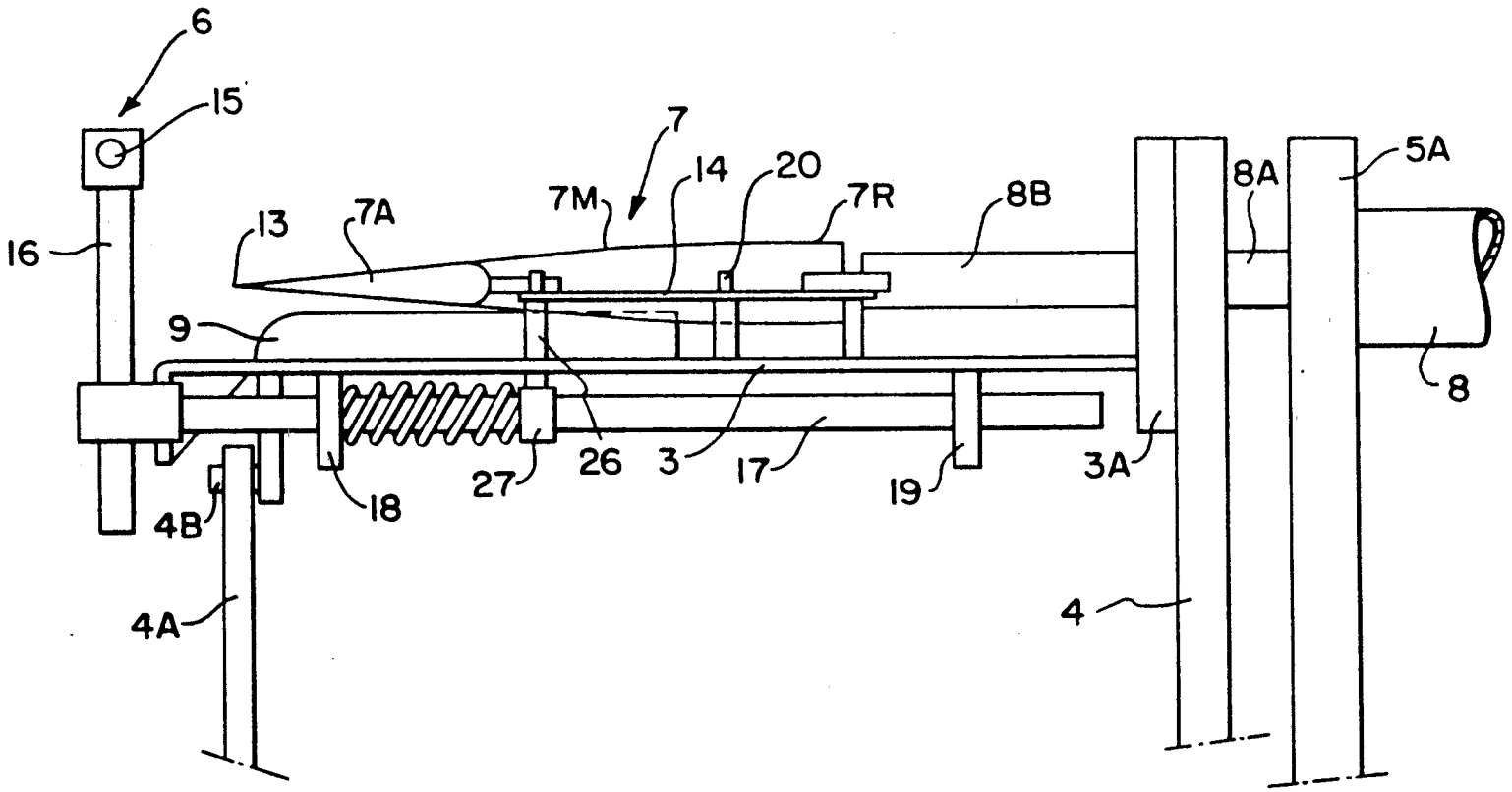
FIG. 3 is a diagrammatical top view of one of the two jaws for securing the timber quarter, carrying one of the splitting tools and a retractable thickness guide which retracts after the start of splitting.
Figure 4:
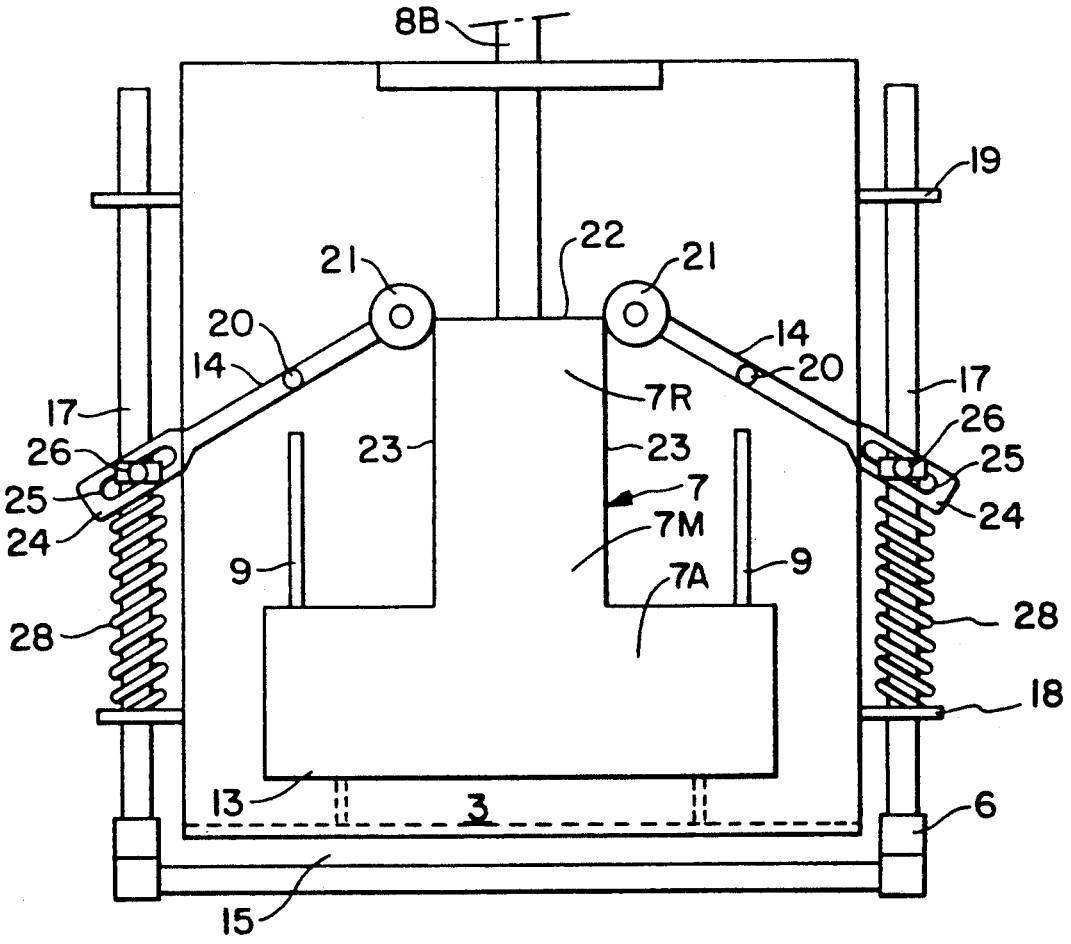
FIG. 4 is a diagrammatical top view of the gripping jaw shown in FIG. 3 and showing the thickness guide feed and retraction control levers.

As can be better seen in FIGS. 3 and 4, the splitting tool (7), shown very diagrammatically, is composed of a wedge-shaped piece the front part of which (7A) has a splitting edge (13) whose upper and lower surfaces have a continuous slope from this front edge (7M) to the midway section which is slightly convex and whose thickness is less than double that of the thin cut to be produced. This midway section is followed by a rear prolongation (7R) whose upper and lower surfaces are more or less horizontal and which is narrower than the edge (13) to constitute the heel part of the tool engaged to pivot on the free end of the shaft (8B) of the control cylinder (8). It should be noted that this shaft (8B) also serves as the oscillation axis for the corresponding gripping devices (3) and that the tool heel acts as a guide for the lateral and symmetrical levers (14) which control the feed and retraction of the thickness guide (6) which can better be seen in FIG. 4.

As shown in FIG. 4 and FIG. 3, the thickness guide (6) is composed of a transverse bar (15) which is supported by two height adjustable lateral shafts (16). The bottom end of each shaft (16) is engaged in the end clevis of a lateral shaft (17) which is mounted on and slides in side brackets (18, 19) of the corresponding gripping devices (3). Furthermore, each of the levers (14) is mounted to pivot on a pivot (20) and has, at each end of the cylinder (8) shaft (8B), a drive roller (21) designed to run on the end (22) of the tool heel and the sides (23) of the heel. The other end (24) of each lever has a long slot (25) in which a teat (26) is engaged and which is mounted on a bush (27) fixed and adjustable on the sliding shaft (17) and under pressure of a spring (28) which abuts against bracket (18).

One can now more easily understand the functioning of this machine which implements the splitting process according to this invention. In fact, when a timber quarter is lifted by the rest (2) its upper surface comes into abutment with the bottom of the crossbar (15), which is preset to the thickness of a thin cut, thickness guides (6) oscillate respectively each of the gripping devices (3) and the corresponding splitting tool (7) by means of the upper ribs (9) on these gripping devices. The gripping devices (3) are then actuated by the cylinders (5) to grip the ends of the timber quarter (12). Immediately after the gripping, the cylinders (8) are actuated simultaneously and push on the splitting tools whose front edge (13) comes up against the corresponding respective end of the timber quarter, in order to start the splitting operation in a single pass to obtain the thin cut of the thickness determined by the thickness guide the bottom of the bar (15) of which has been set to a gap, in relation to the edge of the splitting tool, corresponding to the thickness chosen. Moreover, as soon as the splitting tools begin to move forward, the rollers (21) of the lateral levers (14) have moved along the sides (23) of the heel part of the tools, then on the rear ends (22) of same, thus leaving the levers to tilt under the pressure of the springs (28) which have pushed the fixed bushes (27) of the thickness guide support lateral sliding shafts (17) causing the thickness guides to move to a position short of the leading edge of the gripping devices (3) and, therefore, the ends of the timber quarters.

I claim:

1. A method of splitting a short timber into thin cuts comprising the steps of gripping the ends of the timber so as to hold it in a fixed position, simultaneously engaging the ends of the timber with a pair of splitting tools which are movable inwardly toward each other so as to follow the grain of the wood and to provide a thin cut of a predetermined thickness which is cut from a longitudinal part of the timber disposed on one surface thereof.

2. A method according to claim 1 wherein the ends of the timber are gripped by a pair of gripping devices in such manner that the upper surface of the timber is disposed in a plane above the jaws and wherein the ends of the timber are engaged by inwardly movable splitting tools whose cutting edges are situated at a level below the upper surface of the timber whereby the thickness of cuts is determined.

3. A method according to claim 1 wherein the short timber is manipulated so that said longitudinal part of the timber becomes the underside of the timber and the opposed longitudinal part of the timber becomes the topside thereof in order to obtain a thin cut from the now topside of the timber.

4. A method according to claim 3 wherein the method of claim 3 is repeated until the timber is used up.

5. A machine for splitting timber quarters into thin cuts of a predetermined thickness comprising a support chassis, a cradle for the timber quarter to be split and located on the support chassis and arranged to hold the quarter in a horizontal position centered along the horizontal axis of the support chassis, a pair of gripping devices having ribs and movable along said chassis and positioned to engage and grip the timber quarter at its longitudinal ends and each mounted on a support which moves longitudinally along the chassis to a position in which the timber quarter is gripped by its ends; a thickness guide for oscillating each of said ribs for each of the thin cuts to be produced, and a splitting tool located above each of the gripping devices and guided on the top of the corresponding jaw.

6. A splitting machine according to claim 5 characterized by the fact that each splitting tool is composed of a wedge-shaped part whose width is greater than that of the longitudinal face of the quarter from which each thin cut is to be produced, the front of the wedge shaped part having, on each upper and lower side, a continuous slope from the front edge to the middle part which is convex and, then, a rear more or less horizontal flat part which constitutes the heel part of the tool which is narrower than the front part and which acts as a gradual penetration splinter in the wood without cutting the wood fibers but which parts these fibers in layers in the direction of the wood grain, the rear part of which has its upper and lower surfaces parallel to maintain the opening obtained by the middle section and whose thickness is less than double the thin cut, this convex middle part tending to continuously separate, without splintering the wood of the thin cut produced from the timber quarter and the final separation of this thin cut.

7. A splitting machine according to claim 5 wherein a pair of levers are linked with an associated thickness guide and wherein each splitting tool is designed to act as a guide cam for one of the ends of each of the levers linked by the other end thereof to the corresponding thickness guide and in order to actuate its retraction when the tool is in the forward position and in order to start the splitting operation.

8. A splitting machine according to claim 5 characterized by the fact that each thickness guide consists of a stop transverse to the axis of movement of the gripping devices which is designed for height adjustment in relation to the front edge of the splitting tool in its initial position located on a parallel plane above the corresponding gripping device in order to define the thickness of the thin cut.

9. A splitting machine according to claim 8, characterized by the fact that side cradle for the timber quarter to be converted into thin cuts comprises two transverse strut systems perpendicular to the longitudinal axis of the machine chassis and held apart from one another by an adjustable system to support at its ends, a timber quarter, each strut system comprising two pieces in the form of "V" cradles, which are actuated to move in opposite directions to one another and in one direction or another respectively in order to form a "W" the center branches of which due to their crossover form an "X" in which the crossover point may vary in height as required and vertically in relation to the central longitudinal axis of the chassis in order to set the required splitting position of the timber quarter lying in the upper "V" form of each strut system.

10. A splitting machine according to claim 9, characterized by the fact that movements in opposite directions to one another of the two strut systems are actuated by rotation in one direction or the other, by a gearwheel meshed with two opposing rack systems each of which is fixed to the base of one strut system.

11. A splitting machine according to claim 9 characterized by the fact that the two "V" shaped pieces each constitutes the transverse strut system of the cradle have their arms designed to articulate in order to be able to vary their opening angle as required in relation to the angular value of the timber quarter to be converted into thin cuts, either 90 degrees for a quarter of one eighth, or 120 degrees for a quarter of one twelfth.

12. A machine for splitting timber quarters into thin cuts of a determined thickness using splitting tools each actuated by thrust for the splitting operation and retraction at the end of it by a relevant cylinder (8) and comprising a rest (2) or cradle for the timber quarter to be split, located in the center of the support chassis (1) and designed to lift said timber quarter in a horizontal position centering it along the horizontal axis of this support chassis (1), two moving gripping devices (3) along this longitudinal axis, positioned transversely to said longitudinal axis to trap the timber quarter by its longitudinal ends, said gripping devices being mounted on a support (4) which moves longitudinally along the chassis (1) to a position in which the timber quarter is gripped by its ends, a thickness guide (6) for each of the thin cuts to be produced by splitting with an adjustable and moving mounting above each of the jaws (3) and overhanging in relation to the front edge or jaw respectively to the gripping device in order to constitute a stop (15) for the longitudinal upper side of the timber quarter and to calibrate the thickness chosen of the thin cut to be produced by forcing the gripping device (3) which carries this stop (15) to position itself by transverse oscillation in a plane parallel to that of the upper longitudinal surface of the timber quarter, before actuating the tightening movement of these gripping devices, a splitting tool (7) located above each of gripping devices, flat guided on the top of the corresponding jaw in order to position them for splitting and during release during retraction of the corresponding thickness guide (6), then left free to oscillate transversely on the shaft of its thrust cylinder (6) when its middle part has gone beyond the leading edge of the gripping device.

* * * * *